United States Patent [19]

Whitehouse

[11] Patent Number: 4,462,775

[45] Date of Patent: Jul. 31, 1984

[54] ROTARY PISTON MACHINE WITH MATING FRUSTOCONICAL SEALING SURFACE

[76] Inventor: Ronald C. N. Whitehouse, 34c Netherhall Gardens, London, N.W.3, England

[21] Appl. No.: 480,036

[22] Filed: Mar. 29, 1983

Related U.S. Application Data

[63] Continuation of Ser. No. 160,779, Jun. 18, 1980, abandoned.

[30] Foreign Application Priority Data

Jun. 22, 1979 [GB] United Kingdom ..... 21762/79
Jul. 13, 1979 [GB] United Kingdom ..... 24448/79

[51] Int. Cl.[3] ..... F01C 1/08; F01C 19/00; F01C 21/08; F01C 21/10

[52] U.S. Cl. ..... 418/107; 418/111; 418/194; 418/196; 418/227

[58] Field of Search ..... 418/107, 110, 111, 194, 418/196, 227

[56] References Cited

U.S. PATENT DOCUMENTS

| | | | |
|---|---|---|---|
| 540,727 | 6/1895 | Dixon | 277/115 |
| 722,480 | 3/1903 | Bergmann | 418/139 |
| 1,020,842 | 3/1912 | Ogden | 418/196 |
| 1,268,771 | 6/1918 | Randolph | 418/194 |
| 1,782,766 | 11/1930 | Randolph | 418/194 |
| 2,210,152 | 8/1940 | Sacha | 418/194 |
| 2,236,370 | 3/1941 | Jackman | 277/115 |
| 3,852,001 | 12/1974 | Miller | 418/196 |

FOREIGN PATENT DOCUMENTS

| | | | |
|---|---|---|---|
| 185566 | 9/1922 | United Kingdom | 418/194 |

*Primary Examiner*—John J. Vrablik
*Attorney, Agent, or Firm*—Edwin E. Greigg

[57] ABSTRACT

A rotary fluid machine of the kind that is to be actuated by any fluid under pressure in which a rotor (15) carrying a piston member ($15_4$) rotates continuously when the machine is in operation about the axis (AA1) of an annular chamber (21), the piston member ($15_4$) is geared to rotary obturators ($17_A$, $17_B$) that rotate in sealing chambers $21_1$ in an annular member $21_2$ projecting into the annular chamber 21 about an axis (BB1, CC1) substantially parallel to said axis (AA1) of the annular chamber (21) and the rotary obturator has a recess into which a part of the piston enters during rotation to provide a working section in the cylinder as working fluid is fed to the piston. The machine is characterized in that the piston member ($15_4$) has a frusto-conical peripheral surface (G1, G2) that seals with a frusto-conical mating surface of its annular chamber, the two surfaces being kept into sealing contact by an axial force of the axis (AA1) of a right cone common to both said surfaces.

7 Claims, 5 Drawing Figures

15B
21₂
21
15
15A
10
12
11
C
17B
34B
21₁
19₂
20₂
C1
18₄
24B
16
CL3
15₄
18₂
33B
14₂
21
15₂
15₃
14₃
A
A1
13
13₁
14₁
22
23
15₁
CL1
33A
G2
15
18₃
G1
24A
20₃
18₁
B
B1
CL2
34A
17
19₁
20₁
16
12
11
10

ROTARY PISTON MACHINE WITH MATING FRUSTOCONICAL SEALING SURFACE

This is a continuation, of application Ser. No. 160,779, filed June 18, 1980, now abandoned.

DESCRIPTION

This invention relates to a rotary fluid machine of the kind (hereinafter referred to as the kind set forth) comprising a rotor carrying a piston member that rotates continuously when the machine is in operation about the axis of an annular chamber, the piston member is mechanically linked to a rotary obturator that rotates in a sealing chamber about an axis substantially parallel to said axis of the said annular chamber and the rotary obturator has a recess into which a part of the piston enters during rotation to provide a working section in the cylinder as working fluid is fed to the piston.

The term fluid machine is to have a wide meaning to embrace inter alia an engine, a pump, a compressor or a brake in which work is done.

Such rotary fluid machines are known for example from the specifications of United Kingdom Patent Specification Nos. 365,520 to Elrick and No. 407,661 to Societe Les Turbo-Moteurs Guy and from U.S. Pat. No. 3,354,871 to Skrob. It has proved exceptionally difficult to seal the rotary obturator and without effective sealing the engine is inefficient and this difficulty is fully explained by Skrob (3 17–21).

According to the present invention there is provided a rotary fluid machine of the kind set forth wherein the piston member has a frusto-conical peripheral surface that seals with a frusto-conical mating surface of the annular chamber, the two frusto-conical surfaces are kept in sealing contact by an axial force that is directed along the axis of a right cone common to both said frusto-conical surfaces, the axis being the axis of rotation of the piston member.

In one arrangement the rotary obturator is also of frusto-conical form and axially forced into sealing contact with its sealing chamber that is of complimentary shape. Alternatively the rotary obturator may be one of the divided forms described in my co-pending application Ser. No. 482,378, which is a continuation of application Ser. No. 160,761, filed June 18, 1980, now abandoned.

The invention will be more fully understood from the following description given by way of example only with reference to the figures of the accompanying drawings in which.

Figures 1, 1A:
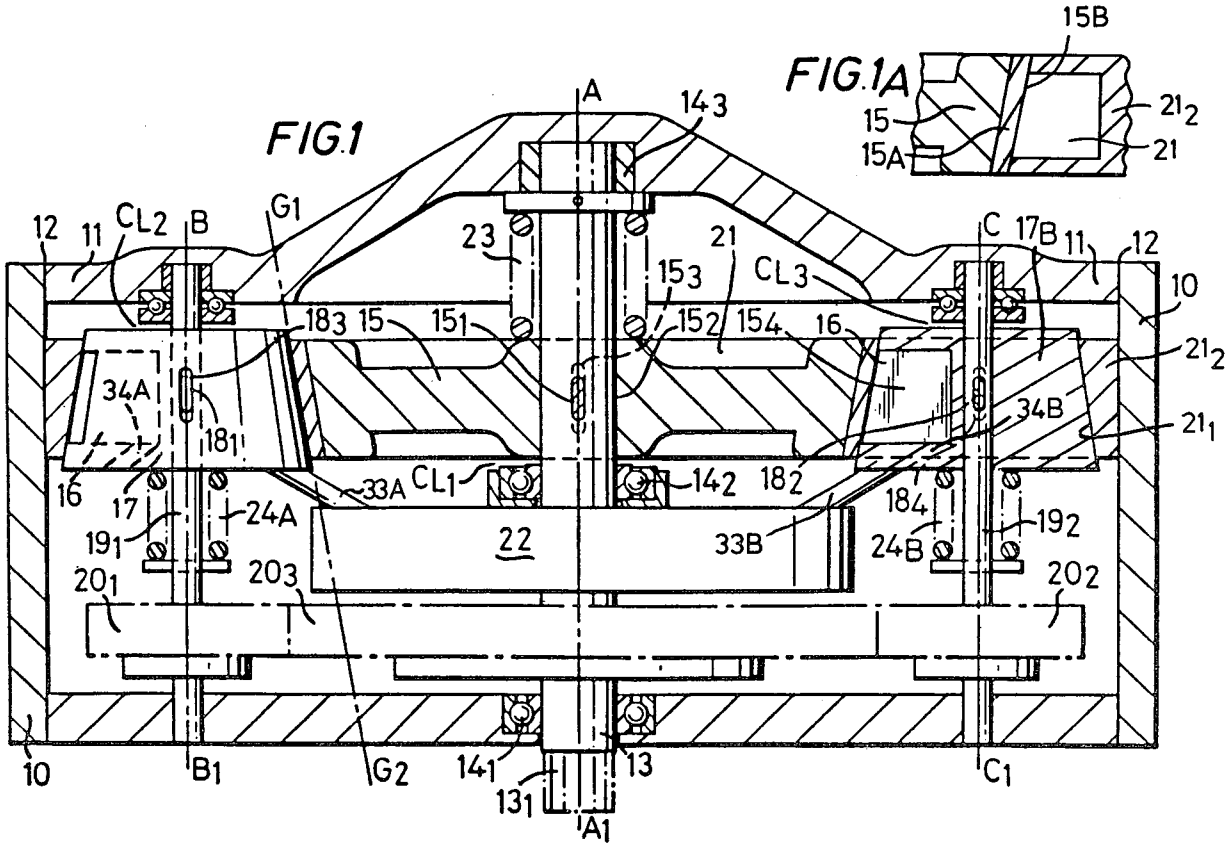
FIG. 1 is an elevation in section of a rotary machine of the invention.
FIG. 1A is a part section of the piston and cylinder in mating contact.

Referring now to FIG. 1 a block 10 has a head 11 spigot jointing at 12 and carrying a centrally journalled power shaft 13 in bearings $\mathbf{14}_1$, $\mathbf{14}_2$ and $\mathbf{14}_3$. The shaft 13 carries a rotary piston member 15 keyed at $\mathbf{15}_1$ and splined at $\mathbf{15}_2$ to said shaft with allowance for movement of the key at $\mathbf{15}_3$. The piston has three working piston parts of which one only is shown at $\mathbf{15}_4$ said piston entering a piston recess such as 16 in rotary obturators 17A and 17B of a diametrally opposed pair, its fellow obturator being at 17B. Each rotary obturator is keyed at $\mathbf{18}_1$, $\mathbf{18}_2$ and splined if necessary to a shaft $\mathbf{19}_1$, $\mathbf{19}_2$, each key is provided with an allowance for movement of the shaft at $\mathbf{18}_3$, $\mathbf{18}_4$. Gears $\mathbf{20}_1$, $\mathbf{20}_2$ on shafts $\mathbf{19}_1$, $\mathbf{19}_2$ mesh with gear $\mathbf{20}_3$ on shaft 13 that has a power output end at $\mathbf{13}_1$.

Steam or other suitable working fluid is fed to annular chamber and expansion cylinder 21 containing the rotary piston 15 by means of a metering unit shown generally at 22. Any suitable metering unit may be used and one such unit is described in my co-pending Application No. 482,378. Steam is directed through channels 33A and 33B through openings 34A and 34B in the obturators to the recess 16 where the steam applies a force on the piston $\mathbf{15}_4$.

Rotary piston 15 has a frusto-conical peripheral sealing surface 15A that seals with a like frusto-conical sealing surface at 15B of the wall $\mathbf{21}_2$ of the annular chamber 21 shown inset in FIG. 1A and taken at a section station away from the rotary obturators. Mating surfaces 15A, 15B are each part of a common right cone having its axis on the axis $AA_1$ of shaft 13 as represented by the single incomplete generator $G_1$, $G_2$. Suitable clearance for take-up of wear is left at position $CL_1$.

The rotary piston 15 is spring urged along the axis $AA_1$ by helical compression spring 23. Similarly frusto-conical rotary obturators 17A, 17B are individually spring urged by helical compression springs 24A, 24B along the axis $BB_1$, $CC_1$ of their respective shafts $\mathbf{19}_1$, $\mathbf{19}_2$ so that said obturators 17A, 17B seal against complementary mating frusto-conical surfaces of their respective sealing chambers $\mathbf{21}_1$ in the annular member $\mathbf{21}_2$ and thus with wear the all important seal is efficaciously maintained, a suitable clearance being left at position $CL_2$, $CL_3$.

Figure 2:
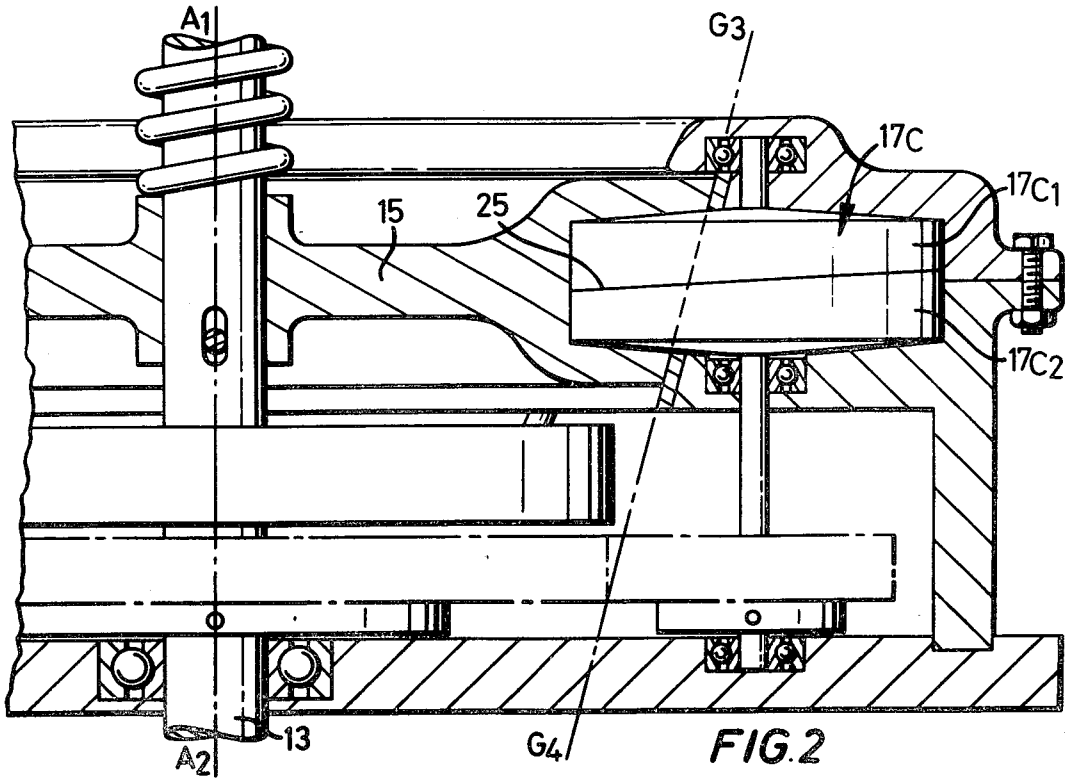
FIG. 2 is a part section similar to FIG. 1 of an alternative arrangement to a larger scale.

In FIG. 2 a rotary obturator shown generally at 17C is of a form described and claimed in my co-pending application Ser. No. 482,378. The rotary obturator has two parts $\mathbf{17C}_1$, $\mathbf{17C}_2$ that are spring urged by a spring 35, as exemplified in FIG. 3A, helically along line 25 to expand continuously and thus effect good sealing at all times, irrespective of wear and thermal expansion with the internal surfaces of its sealing chamber. The piston rotor 15 as in FIG. 1 mates on frusto-conical surface of a common right cone shown by the single generator $G_3$, $G_4$ that meets when extended on the center line AA1 of pison shaft 15.

Figure 3:
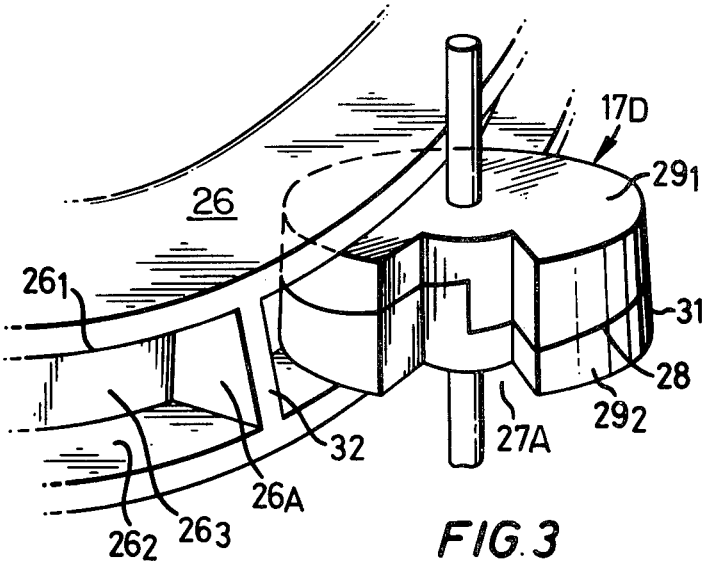
FIG. 3 is a view in perspective of a part of a piston and one rotary obturator of an alternative construction and FIG. 3A is a detail in section.
Figure 3A:
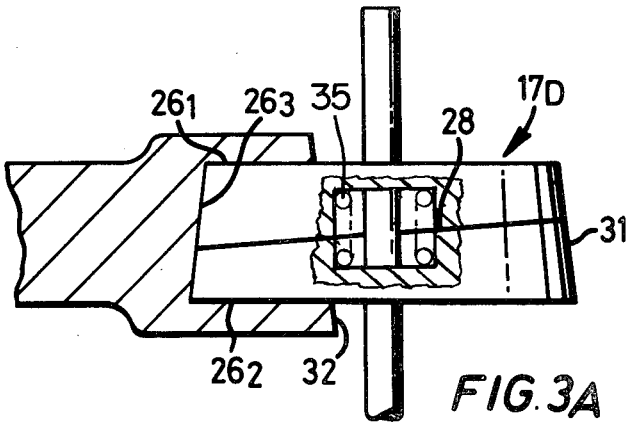

In FIG. 3 a piston 26 of a different construction from that of FIGS. 1 and 2 is of a singularly robust form. The piston 26 has an internal piston face $\mathbf{26}_A$ co-operating with a piston recess 27A in a separable rotary obturator shown generally at 17D that is able continuously to expand on a helical surface 28 so that surfaces $\mathbf{29}_1$, $\mathbf{29}_2$ always mate with the surfaces $\mathbf{26}_1$, $\mathbf{26}_2$ of the piston 26. It is to be noted that the piston surface $\mathbf{26}_3$ is also frusto-conical to mate with a similar surface 31 of the obturator (FIG. 3A). The piston also has a frusto-conical sealing surface at 32 that mates with a similar wall surface (not shown). The piston member is provided with a piston working part 26A annularly enclosed on three sides $\mathbf{26}_1$, $\mathbf{26}_2$, $\mathbf{26}_3$; the obturator sealing with two of the said opposed sides viz: $\mathbf{26}_1$, $\mathbf{26}_2$.

I claim:

1. A rotary piston machine comprising a housing having an annular chamber, shaft means carrying a rotary piston member for continuous rotation about an axis of said annular chamber when the machine is in operation, means mechanically linking said piston member to a rotary obturator means rotatably received in a sealing chamber for rotation about an axis substantially parallel to said axis of rotation of said piston member, said rotary obturator means having a recess into which a part of the piston member enters during rotation to provide a working section in said annular chamber as a working fluid is fed to said piston member, said piston member having a frusto-conical peripheral surface that seals against a frusto-conical mating surface of the annular chamber, and biasing means maintaining said two frustoconical surfaces in sealing contact, said biasing means exerting a force that is directed along an axis of a right cone common to both said frusto-conical surfaces, said cone axis being the axis of rotation of said rotary piston member.

2. A rotary piston machine according to claim 1 wherein the rotary obturator means comprises at least two parts having mating engagement along an incline, and biasing means continuously urging one of said parts relative to the other along said incline to keep at least a part of an exterior surface of said obturator means in sealing contact with the juxtaposed interior surface of its sealing chamber.

3. A rotary piston machine according to claim 2 wherein the incline is a helical surface.

4. A rotary piston machine according to claim 1, in which said rotary obturator means and said sealing chamber have mating surfaces of complementary frusto-conical form, and a biasing means axially urges said rotary obturator means into sealing contact with said sealing chamber.

5. A rotary piston machine according to claim 4 in which the biasing means urging said mating surfaces of said frusto-conical obturator means and sealing chamber into sealing contact is a spring means.

6. A rotary piston machine according to claim 5 wherein one of the frusto-conical surfaces of any mating pair of such surfaces is on a member attached to a splined shaft allowing axial movement along said shaft.

7. A rotary piston machine according to claim 1 wherein the piston member has piston working parts annularly enclosed on three sides, said obturator means sealing with two opposed sides of the said annularly enclosed sides of the piston member.

* * * * *